US008438762B2

(12) United States Patent
Lapauw et al.

(10) Patent No.: US 8,438,762 B2
(45) Date of Patent: May 14, 2013

(54) FEEDING DEVICE FOR FEEDING A PIECE OF LINEN TO BE IRONED INTO AN IRONING UNIT, AND IRONING DEVICE PROVIDED WITH SUCH A FEEDING DEVICE

(75) Inventors: Dominique Lapauw, Heule (BE); Yves Lapauw, Heule (BE)

(73) Assignee: Lapauw International NV (BE)

( * ) Notice: Subject to any disclaimer, the term of this patent is extended or adjusted under 35 U.S.C. 154(b) by 144 days.

(21) Appl. No.: 12/934,765

(22) PCT Filed: Mar. 30, 2009

(86) PCT No.: PCT/IB2009/005117

§ 371 (c)(1),
(2), (4) Date: Nov. 9, 2010

(87) PCT Pub. No.: WO2009/118644

PCT Pub. Date: Oct. 1, 2009

(65) Prior Publication Data

US 2011/0107628 A1 May 12, 2011

(30) Foreign Application Priority Data

Mar. 28, 2008 (BE) ..... 2008/0194

(51) Int. Cl.
*D06F 67/04* (2006.01)
*D06F 69/00* (2006.01)

(52) U.S. Cl.
USPC ..... 38/143

(58) Field of Classification Search ..... 198/373, 198/379, 380; 38/143
See application file for complete search history.

(56) References Cited

U.S. PATENT DOCUMENTS

| | | | | | |
|---|---|---|---|---|---|
| 3,414,997 | A | * | 12/1968 | Henry | 38/143 |
| 3,729,846 | A | * | 5/1973 | Weir | 38/143 |
| 4,729,181 | A | * | 3/1988 | Weir | 38/143 |
| 4,967,495 | A | * | 11/1990 | Weir | 38/143 |
| 5,416,992 | A | * | 5/1995 | Ueda et al. | 38/143 |
| 5,469,955 | A | * | 11/1995 | Van Rumpt | 198/689.1 |

FOREIGN PATENT DOCUMENTS

| | | | |
|---|---|---|---|
| JP | 07194900 | A | 8/1995 |
| JP | 08324858 | A | 12/1996 |
| JP | 2007159921 | A | 6/2007 |

OTHER PUBLICATIONS

Written Opinion of the ISA from ISA/EPO dated Jan. 5, 2011.

* cited by examiner

*Primary Examiner* — Ismael Izaguirre
(74) *Attorney, Agent, or Firm* — Symbus Law Group, LLC; Clifford D. Hyra

(57) ABSTRACT

A feeding device for introducing a piece of linen to be ironed into an ironing unit by means of suction, the feeding device being provided with a suction shaft into which the piece of linen can be sucked and a top suction portion which is provided for sucking the piece of linen into the suction shaft, where the feeding device includes a blocking clamp which is provided to secure the item of linen in a clamping position, and which is arranged in the feeding device in such a way that there is located after the clamping of the item of linen a portion of this item of linen above this blocking clamp that can be sucked by the top suction portion into the suction shaft. An ironing device includes an ironing unit for ironing of linen and a feeding unit for feeding the linen to be ironed into the ironing unit.

8 Claims, 2 Drawing Sheets

FEEDING DEVICE FOR FEEDING A PIECE OF LINEN TO BE IRONED INTO AN IRONING UNIT, AND IRONING DEVICE PROVIDED WITH SUCH A FEEDING DEVICE

This application claims the benefit of Belgian patent application No. 2008/0194, filed Mar. 28, 2008, which is hereby incorporated by reference in its entirety.

BACKGROUND

The term "linen" includes bed linen such as inter alia sheets, fitted sheets, draw sheets, bedspreads, duvet sheets, pillow cases, etc. and also table linen such as inter alia tablecloths and napkins, etc. having a minimum width of 1 m and a maximum width of 3.3 m. Flat products made of terry toweling are not included here.

A feeding device of this type is already known from EP 1 413 665 which describes a feed system wherein two corners of the piece of linen to be ironed are manually clamped. These corners are taken over by another pair of clamps which will spread the piece of linen to be ironed. The spread piece of linen is subsequently deposited on a controller which can move forwards and backwards and deposits the piece of linen to be ironed on feed belts which lead the item of linen to be ironed to the ironing unit.

However, the disadvantage of such a device is that during the transfer of the item of linen to be ironed from the feeding device to the ironing unit, this piece of linen to be ironed has to be continuously clamped, which is disadvantageous, since when 2 corners are clamped, tension is at all times exerted on the edge of the item of linen to be ironed and this piece of linen to be ironed is deformed. In addition, the ironing capacity per person is less because said person must, for each piece of linen to be ironed, look for the 2 points of this piece of linen to be ironed and introduce them into 2 clamps.

In EP 1 160 370 a device is described for supplying items of laundry to an ironing mangle. Therewith, a piece of laundry is deposited from clamps on a conveyor belt. The clamps move therewith over this conveyor belt in order to spread the item of laundry. During this process, at least a part of the bottom clamping halves of the clamps hold the item of laundry in contact with the conveyor belt.

A similar system which is based on the same principle is described in DD 238 409.

However, these systems are mainly mechanical systems which do not operate on the principle of suction in order to bring the item of laundry to the ironing mangle. The item of laundry is however spread with the aid of two clamps. The only suction which takes place is produced by the conveyor belt in order to suck said item of laundry against the conveyor belt. As a result of the fact that the item of laundry is clamped, tension is at all times exerted on the edge of the item of laundry to be ironed and this item of laundry to be ironed is deformed. Such devices thus contain many mechanical components, as a result of which they operate slowly and as a result of which the risk of faults is increased owing to the large number of movements which are to take place in these devices.

In DE 90 14 821, a device is described for supplying items of laundry of different size, for example tablecloths on the one hand and hand towels on the other hand, to an ironing mangle. Therewith, the device comprises various charging devices which are positioned next to one another and are provided with an air-permeable surface which can be provided with reduced pressure. These charging devices are arranged so as to be able to move back and forth. Furthermore, a conveyor belt, on which at the upper part thereof air can be sucked off, is provided below these supporting devices. In order to introduce a piece of laundry into the ironing mangle, this item is laid, depending on the size thereof, on one or more charging devices which suck in this item of laundry and take it along until this item of laundry can be deposited on the conveyor belt which then further takes along the item of laundry in the direction of the ironing mangle.

However, the disadvantage of this device is that the back-and-forth movement which the supporting devices are to carry out necessitates a large number of mechanical components, as a result of which the device operates slowly. In addition, the large number of movements which are carried out in the device increases the risk of faults.

In the Japanese patent application JP 07194900 a suction system is described which is provided with

- a suction space which is exerted in a tunnel-shaped manner toward an open input side of the suction system and which is exerted narrower toward the inside of a conveyor belt of the suction system;
- a top and a bottom suction portion which are provided for sucking off the air in the suction space and which are provided at the upper and the underside of the bottom surface of the aforementioned conveyor belt;
- a linen holder for suspending a piece of linen close to the input side of the suction space and which is mounted at the upper side of this suction space;
- an air jet pipe for blowing an air flow in order to push the top end of the linen into the suction space when the linen is detached from the linen holder.

The disadvantage of this suction system is, again, that the linen is spread with the aid of two clamps, as a result of which tension is at all times exerted on the edge of the piece of linen to be ironed and this item of linen to be ironed is deformed. A further disadvantage is that this suction system does not operate efficiently since, when the linen holder releases the linen in order to allow said linen to be sucked into the suction space, there is a high risk that said linen will fall downward. In addition, the system is complex as a result of the use of the aforementioned air jet pipe.

SUMMARY

The invention relates to a feeding device for introducing a piece of linen to be ironed into an ironing unit, the feeding device being provided with a suction system for introducing the item of linen, which is introduced into the feeding device, into the ironing unit by means of suction, the suction system being provided with

- a suction shaft into which the piece of linen can be sucked;
- a top suction portion which is provided for sucking the item of linen into the suction shaft.

The object of the invention is accordingly to provide a feeding device for feeding a piece of linen to be honed into an ironing unit, wherein the item of linen to be ironed is introduced into the ironing unit without tension, and thus deformation of the piece of linen to be ironed, with a minimum risk of falling, and a maximum ironing quality to be obtained.

This object of the invention is achieved by providing a feeding device for introducing a piece of linen to be ironed into an ironing unit, the feeding device being provided with a suction system for introducing the piece of linen, which is introduced into the feeding device, into the ironing unit by means of suction, the suction system being provided with

- a suction shaft into which the piece of linen can be sucked;
- a top suction portion which is provided for sucking the piece of linen into the suction shaft;

wherein the suction system comprises a blocking clamp which is provided to clamp the piece of linen in a clamping position, and which is arranged in the feeding device in such a way that, after the clamping of the piece of linen, a portion of this piece of linen is situated above this blocking clamp that can be sucked into the suction shaft by the top suction portion.

As a result, the linen introduced into the feeding unit can be introduced into the ironing unit without tension, and thus without deformation of the piece of linen to be ironed, and with a very low risk of falling. In addition, as a result of the fact that the piece of linen is clamped in the manner described hereinbefore, said piece of linen is introduced into the ironing unit in all cases in a nicely horizontal manner, as a result of which, after the ironing of this item of linen, the 2 edges thereof can be laid nicely one on the other and this piece of linen can be folded up perfectly. In addition, the piece of linen vibrates at that moment in the suction shaft, as a result of which perfect ironing quality is obtained.

In a preferred embodiment of a feeding device according to the invention, the feeding device is provided with a bottom suction portion which is provided for further taking the piece of linen, which is partly sucked up by the top suction portion into the suction shaft, along in the direction of the ironing unit once the blocking clamp has proceeded to a release position wherein this blocking clamp has released the piece of linen and once the top suction portion is set to non-active.

In an advantageous embodiment of a feeding device according to the invention, the bottom suction portion consists of one or more perforated conveyor belts, wherein the piece of linen is sucked against the perforated conveyor belts as a result of suction through the perforations and is further taking along.

In one particular embodiment of the feeding device according to the invention, the top and bottom suction portions suck in the linen under vacuum.

In a preferred embodiment of a feeding device according to the invention, the feeding device is provided with a closing element which is provided for closing off the suction shaft on the side which is located at the level of the ironing unit.

The provision of such a closing element has the advantage that the suction is significantly improved by the top and bottom suction portion. When sucking-in is carried out under vacuum, the closing element seals the suction shaft at all times almost completely, as a result of which a much better vacuum is created.

In an advantageous embodiment of a feeding device according to the invention, the blocking clamp is arranged so as to be able to rotate between the clamping and release position.

In a more advantageous embodiment of a feeding device according to the invention, the rotational movement of the blocking clamp is controlled by means of a pneumatic cylinder.

In an advantageous embodiment of a feeding device according to the invention, the feeding device is provided with rotatably arranged brushes which are provided for brushing off the side edges of the piece of flat material during the introduction thereof into the ironing unit.

The provision of such brushes has the advantage that the piece of linen is directly laterally spread and as a result the piece of linen can be introduced into the ironing unit without creasing.

Furthermore, this object is achieved by providing an ironing device, comprising an ironing unit for ironing of linen and a feeding unit for feeding the linen to be ironed into the ironing unit, wherein the feeding unit comprises a feeding device according to the invention.

This invention will now be commented on in greater detail based on the subsequent detailed description of a preferred ironing device according to the invention. The purpose of this description is exclusively to provide a clarificatory example and to indicate further advantages and special features of this invention, and may thus in no way be interpreted as a limitation of the scope of application of the invention or of the patent rights sought in the claims.

BRIEF DESCRIPTION OF THE DRAWINGS

In this detailed description, reference numerals are used to refer to the annexed drawings, wherein in FIG. 1 a cross section is shown of a feeding device according to the invention wherein the top suction portion is active.

DETAILED DESCRIPTION

Figure 1:
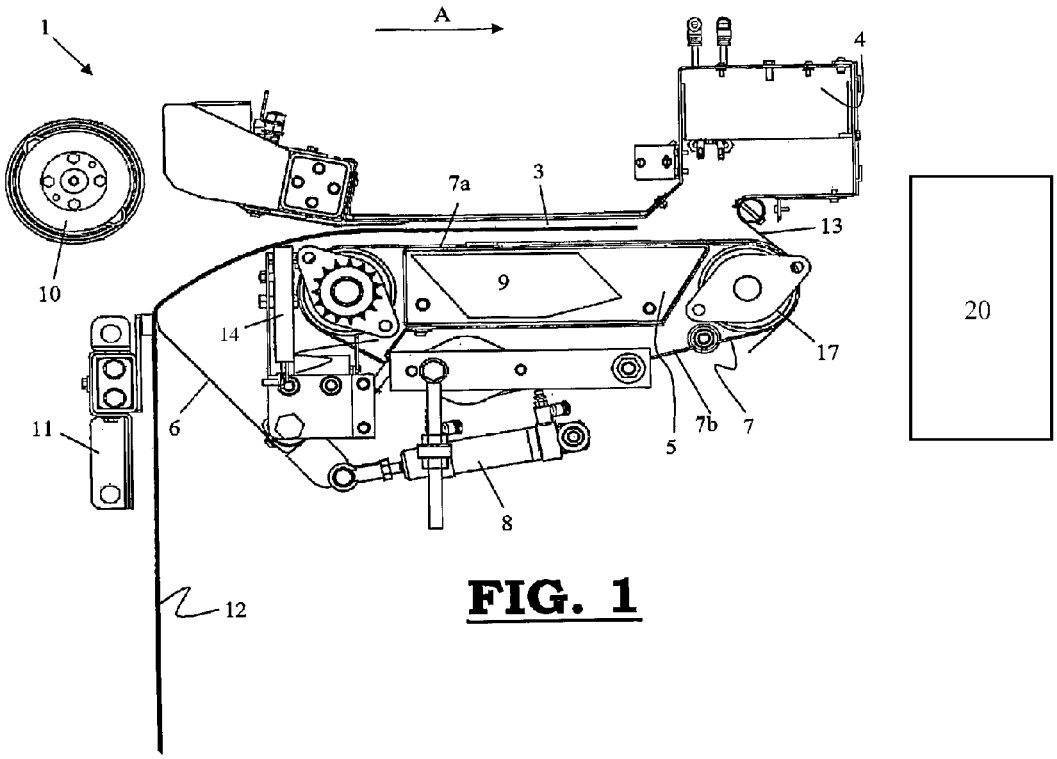

A feeding device (1) for introducing a piece of linen (12) (10) to be ironed into an ironing unit (20) by means of suction is provided with

- a suction shaft (3) into which the piece of linen (12) to be ironed can be sucked up;
- a top and a bottom suction portion (4, 5); and
- a blocking clamp (6).

The blocking clamp (6) is provided to move between a clamping position wherein the piece of linen (12) is clamped and a release position wherein the piece of linen (12) is released again. The blocking clamp (6) is therewith preferably rotatably arranged between this clamping and release position. The rotational movement of the blocking clamp (6) is preferably controlled by means of a pneumatic cylinder (8). However, this blocking clamp (6) can also be controlled hydraulically or in any other manner.

As is illustrated in FIG. 1, the blocking clamp (6) is therewith arranged in such a way that, after the clamping of the piece of linen (12), a portion of this piece of linen (12) is situated above this blocking clamp (6). This preferably takes place on $\frac{1}{3}^{rd}$ of the piece of linen (12). The piece of linen (12) is therewith clamped between the blocking clamp (6) and a beam (11). This beam (11) preferably forms a part of the further feeding device (the further feeding device is not illustrated in the figures).

Rotatably arranged brushes (14) are provided for brushing off the side edges of the piece of linen (12) during the introduction thereof into the ironing unit (20).

The top suction portion (4) is provided for sucking up the portion which is located, after the clamping by the blocking clamp (6), above this blocking clamp (6). As may be seen in FIG. 1, the piece of linen (12) vibrates at that moment in the suction shaft (3), as a result of which perfect ironing quality can be obtained.

Figure 2:
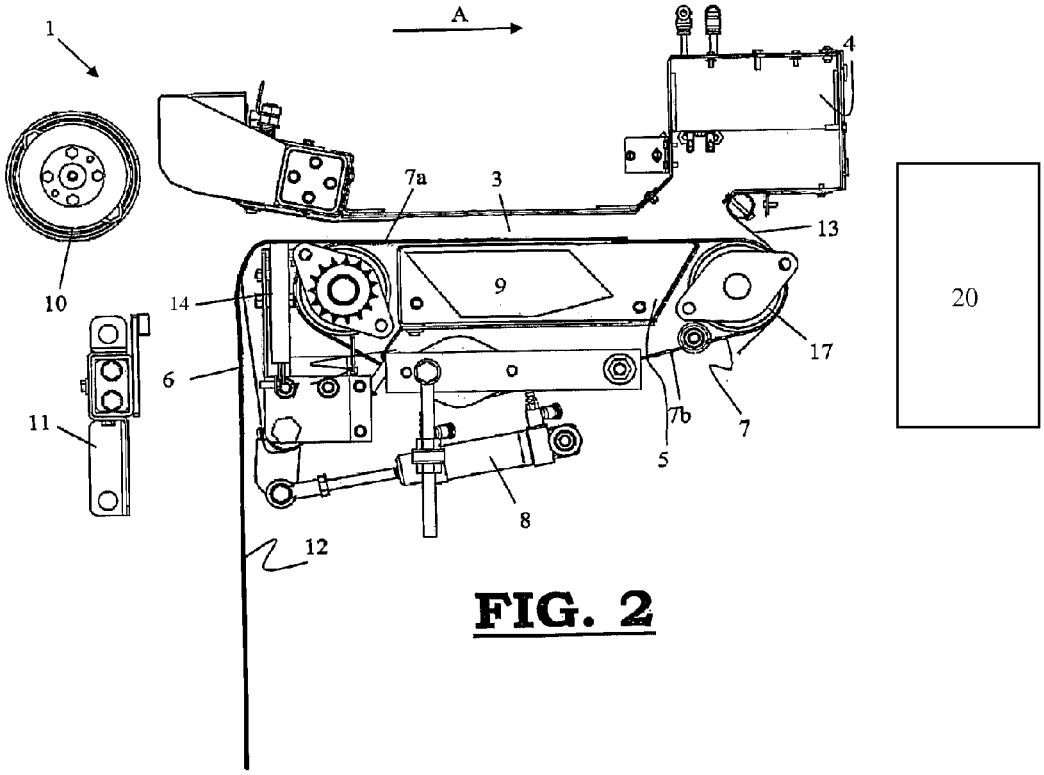
FIG. 2 is a cross section is shown of a feeding device according to the invention wherein the bottom suction portion is active.

The bottom suction portion (5) is provided for further taking along the piece of linen (12), which has been sucked up into the suction shaft (3), in the direction of the ironing unit (20) once the blocking clamp (6) has proceeded to a release position wherein this blocking clamp (6) has released the piece of linen (12) and once the top suction portion (4) is set to non-active. The bottom suction portion (5) consists therewith out of one or more perforated conveyor belts (7), wherein the piece of linen (12) to be taken along is sucked against the perforated conveyor belts (7) because of suction through the perforations (see FIG. 2). These conveyor belts (7) are revolving conveyor belts (7), a suction element (9) being located between the top and bottom portion (7*a*, 7*b*) of these conveyor belts (7).

The feeding device (1) is therewith provided with a valve (not illustrated in the figures) which ensures that the top suction portion (4) and afterwards the bottom suction portion (5) alternately suck air into the suction shaft (3).

In order to obtain efficient extraction by the top and bottom suction portion (4, 5), a closing element (13) is provided at the end of the suction shaft (3) that is positioned at the level of the ironing unit (20). This closing element (13) is preferably made of a Teflon sheet, but can also be made of any other material producing sufficient closure such as cotton or polyester band. This Teflon sheet trails continuously around the conveyor belt which is located around the rearmost roll (17) (=the roll which is located at the level of the ironing unit) (see FIGS. 1 and 2).

The top and bottom suction portions (4, 5) therewith preferably suck in the linen (12) under vacuum. A very good vacuum is created as a result of the provision of the closing element (13).

The piece of linen (12) to be ironed can therewith for example have been introduced on a correction roll (10) which is provided for centering thereon the aforementioned piece of linen (12) and correcting, in interaction with photodetection cells (not illustrated in the figures), the position of the bottom edge of this piece of linen (12) which is located, viewed in the depth direction (A) of the feeding device from the feeding device (1) toward the ironing unit (20), before the correction roll (10), so that this edge extends substantially completely horizontally (or in other words extends substantially parallel to the longitudinal axis of the correction roll (10)).

The invention claimed is:

1. A feeding device for introducing a piece of linen to be ironed into an ironing unit by means of suction, the feeding device being provided with a suction shaft into which the piece of linen can be sucked;

a top suction portion which is provided for sucking the piece of linen into the suction shaft;

wherein the feeding device comprises a blocking clamp which is provided to clamp the piece of linen in a clamping position, and which is arranged in the feeding device in such a way that there is located after the clamping of the piece of linen a portion of this piece of linen above this blocking clamp that can be sucked by the top suction portion into the suction shaft, wherein the feeding device is further provided with a closing element for closing off the suction shaft on the side which is located at the level of the ironing unit.

2. Feeding device as claimed in claim 1, characterized in that the feeding device is provided with a bottom suction portion which is provided for further taking the piece of linen, which is partly sucked up by the top suction portion into the suction shaft, along in the direction of the ironing unit once the blocking clamp has proceeded to a release position wherein this blocking clamp has released the piece of linen and once the top suction portion is set to non-active.

3. Feeding device as claimed in claim 2, characterized in that the bottom suction portion consists of one or more perforated conveyor belts, wherein the piece of linen is sucked against the perforated conveyor belts as a result of suction through the perforations and is further taken along.

4. Feeding device as claimed in claim 2, characterized in that the top and bottom suction portions suck in the linen under vacuum.

5. Feeding device as claimed in claim 1, characterized in that a rotational movement of the blocking clamp is activated by means of a pneumatic cylinder.

6. Feeding device as claimed in claim 1, characterized in that the feeding device is provided with rotatably arranged brushes which are provided for brushing off the side edges of the piece of linen during the introduction thereof into the ironing unit.

7. An ironing device, comprising an ironing unit for ironing of linen and a feeding unit for feeding the linen to be ironed into the ironing unit, wherein the feeding unit comprises a feeding device according to claim 1.

8. Feeding device as claimed in claim 2, wherein the blocking clamp is arranged so as to be able to rotate between the clamping position and the release position.

* * * * *